US010952558B2

(12) United States Patent
Choi

(10) Patent No.: US 10,952,558 B2
(45) Date of Patent: Mar. 23, 2021

(54) DRAPERY CONNECTOR

(71) Applicant: Sam Choi, Arcadia, CA (US)

(72) Inventor: Sam Choi, Arcadia, CA (US)

( * ) Notice: Subject to any disclaimer, the term of this patent is extended or adjusted under 35 U.S.C. 154(b) by 339 days.

(21) Appl. No.: 15/920,777

(22) Filed: Mar. 14, 2018

(65) Prior Publication Data

US 2019/0282018 A1 Sep. 19, 2019

(51) Int. Cl.

| | |
|---|---|
| ***A47H 15/00*** | (2006.01) |
| ***A47H 15/02*** | (2006.01) |
| ***A47H 1/04*** | (2006.01) |
| ***A47H 13/02*** | (2006.01) |

(52) U.S. Cl.

CPC ..... *A47H 15/02* (2013.01); *A47H 1/04* (2013.01); *A47H 13/02* (2013.01)

(58) Field of Classification Search

CPC ... Y10T 16/353; Y10T 16/372; Y10T 16/375; Y10T 16/378; Y10T 16/3834; Y10T 16/3837; Y10T 24/3484; Y10T 24/3485; Y10T 24/3449; Y10T 24/3451; Y10T 24/3452; Y10T 24/51; F16B 2/12; A47H 13/00; A47H 13/01; A47H 13/02; A47H 13/04; A47H 13/06; A47H 13/16; A47H 15/00; A47H 15/02; A47H 15/04

See application file for complete search history.

(56) References Cited

U.S. PATENT DOCUMENTS

| | | | | | |
|---|---|---|---|---|---|
| 3,958,691 | A * | 5/1976 | Schaeffer | B65D 73/02 | 206/326 |
| 4,675,939 | A * | 6/1987 | Fukada | A47H 13/01 | 16/102 |
| 4,846,249 | A * | 7/1989 | Cooper | A47H 15/02 | 160/345 |
| 5,544,387 | A * | 8/1996 | Yamamoto | A47H 13/00 | 16/87.4 R |
| 5,975,187 | A * | 11/1999 | Chou | A47H 5/02 | 160/345 |
| 6,131,243 | A * | 10/2000 | Lee | E06B 9/36 | 16/87.2 |
| 7,698,781 | B2 * | 4/2010 | Cai | A47H 15/02 | 16/106 |

(Continued)

FOREIGN PATENT DOCUMENTS

| | | | | |
|---|---|---|---|---|
| DE | 10251901 A1 * | 7/2003 | ..... | A47H 15/02 |
| FR | 2301212 A1 * | 9/1976 | ..... | A47H 15/02 |

(Continued)

*Primary Examiner* — Chuck Y Mah

(57) ABSTRACT

A drapery connector has an extrusion having an extrusion hollow; a pair of rails formed on the extrusion; a pair of extrusion sidewalls supporting the pair of rails; a pair of rollers engaging the extrusion; a roller frame retaining the axle; and a carriage line connecting the upper carriage to a successive upper carriage. The upper carriage is translationally mounted inside the extrusion in the extrusion hollow. The pair of rollers share a common axle, and the upper carriage has a pair of rollers with a common axle. The roller frame has a roller frame flat face oriented parallel to a wheel inside vertical surface. The upper carriage further has a roller frame. A pair of roller frame flat faces are formed on the roller frame. Each of the roller frame flat faces are closer to the wheel inside vertical surfaces than a thickness of a carriage line.

17 Claims, 4 Drawing Sheets

(56) References Cited

U.S. PATENT DOCUMENTS

| | | | | |
|---|---|---|---|---|
| 7,788,769 | B2 * | 9/2010 | Wicker | A47H 15/02 16/87 R |
| 9,125,511 | B2 * | 9/2015 | Kao | A47H 15/02 |
| 9,480,357 | B2 * | 11/2016 | Price | A47H 1/04 |
| 9,717,362 | B1 * | 8/2017 | Birch | A47H 1/13 |
| 9,943,184 | B1 * | 4/2018 | Kao | A47H 15/02 |
| 9,995,073 | B2 * | 6/2018 | Svenson | E05D 15/26 |
| 2011/0000630 | A1 * | 1/2011 | Huang | A47H 13/01 160/383 |
| 2014/0284005 | A1 * | 9/2014 | Kao | A47H 15/04 160/84.06 |
| 2015/0113769 | A1 * | 4/2015 | Yu | A47H 15/02 16/93 R |
| 2016/0374496 | A1 * | 12/2016 | Marcinik | A47H 1/08 160/331 |
| 2017/0231413 | A1 * | 8/2017 | Schopfer | A47H 15/00 160/330 |

FOREIGN PATENT DOCUMENTS

| | | | | |
|---|---|---|---|---|
| JP | 2009082607 | A | * | 4/2009 |
| KR | 20110045989 | A | * | 5/2011 |
| KR | 101091263 | B1 | * | 12/2011 |

* cited by examiner

DRAPERY CONNECTOR

FIELD OF THE INVENTION

The present invention is in the field of drapery connectors.

DISCUSSION OF RELATED ART

Drapery arrangement includes fabric, a track for sliding, a set of sliding wheels and connections that enable the system to move around the sliding track. As with previous art, the sliding arrangement provides prolonged product life and convenience for adjusting compared to more archaic designs that did not utilize sliding tracks.

One such example of this sliding drapery arrangement is U.S. Pat. No. 7,698,781B2 by Cai, published Apr. 20, 2010 which details an arrangement that utilizes a specialized sliding wheel that provides cheaper labor costs as well as more joint security in the wheel construction.

Another example, by inventor Kuen-Tin Ko, discusses a window curtain system that utilizes rolling balls in U.S. Pat. No. 6,189,182B1 published Feb. 20, 2001. In this example, inventor Ko discusses a guiding block for pulling a window curtain comprised of a pulling plate, a set of wheel seats and a plurality of rolling balls confined within. The rolling action provides a smoother mechanism and also reduces friction and collision within the curtain system. Unfortunately, many of the current systems have a tendency to jam and bind.

SUMMARY OF THE INVENTION

A drapery connector has an extrusion having an extrusion hollow; a pair of rails formed on the extrusion; a pair of extrusion sidewalls supporting the pair of rails; a pair of rollers engaging the extrusion; a roller frame retaining the axle; and a carriage line connecting the upper carriage to a successive upper carriage.

The upper carriage is translationally mounted inside the extrusion in the extrusion hollow. The pair of rollers share a common axle, and the upper carriage has a pair of rollers with a common axle. The roller frame has a roller frame flat face oriented parallel to a wheel inside vertical surface. The upper carriage further has a roller frame. A pair of roller frame flat faces are formed on the roller frame. Each of the roller frame flat faces are closer to the wheel inside vertical surfaces than a thickness of a carriage line.

A roller indent is formed on a roller frame flat face. The pair of rollers have the wheel inside vertical surface at least partially within the roller indent. A roller rounded bevel is formed on the roller between a sloping wall and a wheel flat face. A swivel socket is connected to the roller frame, and the swivel socket receives a connector body. The connector body includes a connector body swivel head received into the swivel socket.

The connector body further includes a connector body swivel shaft extending downwardly from the connector body swivel head. A connector socket frame has a drapery connector socket, and the drapery connector socket receives a drapery snap. The drapery snap is connected to drapery which can be a sheetlike curtain for controlling light through a window. A pair of rail corners of the extrusion rail wall receives the pair of rollers and the rollers ride along the rail corner because the sloping wall slopes toward the wheel axle forming a semi-conical profile of the roller wheels.

It is an object of the invention to create a drapery connector that allows gliding movement without binding.

The following call out list of elements can be a useful guide in referencing the elements of the drawings.

20 Connector Body
21 Drapery Connector Socket
22 Lower Connector Body
23 Connector Body Swivel Shaft
24 Connector Body Swivel Head
25 Swivel Socket
26 Swivel Socket Notch
27 Swivel Head Side Wall
28 Connector Body Face
29 Connector Socket Frame
30 Upper Carriage
31 Carriage Disk
32 Carriage Stem
33 Carriage Line
34 Retainer Face
35 Sloping Wall
36 Wheel Flat Face
37 Roller Frame
38 Wheel Axle
39 Roller Wheel
41 Roller Seal
42 Inside Roller Bearing
43 Roller Rounded Bevel
44 Roller Ridge
45 Roller Indent
46 Drapery
47 Drapery Snap
48 Wheel Inside Vertical Surface
49 Wheel Outside Vertical Surface
50 Extrusion
51 Extrusion Top Wall
52 Extrusion Sidewall
53 Extrusion Rail Wall
54 Extrusion Hollow
55 Front Roller
56 Rear Roller
57 Roller Frame Flat Face
58 Successive Upper Carriage
59 Rail Corner

DETAILED DESCRIPTION OF THE PREFERRED EMBODIMENT

Figure 1:
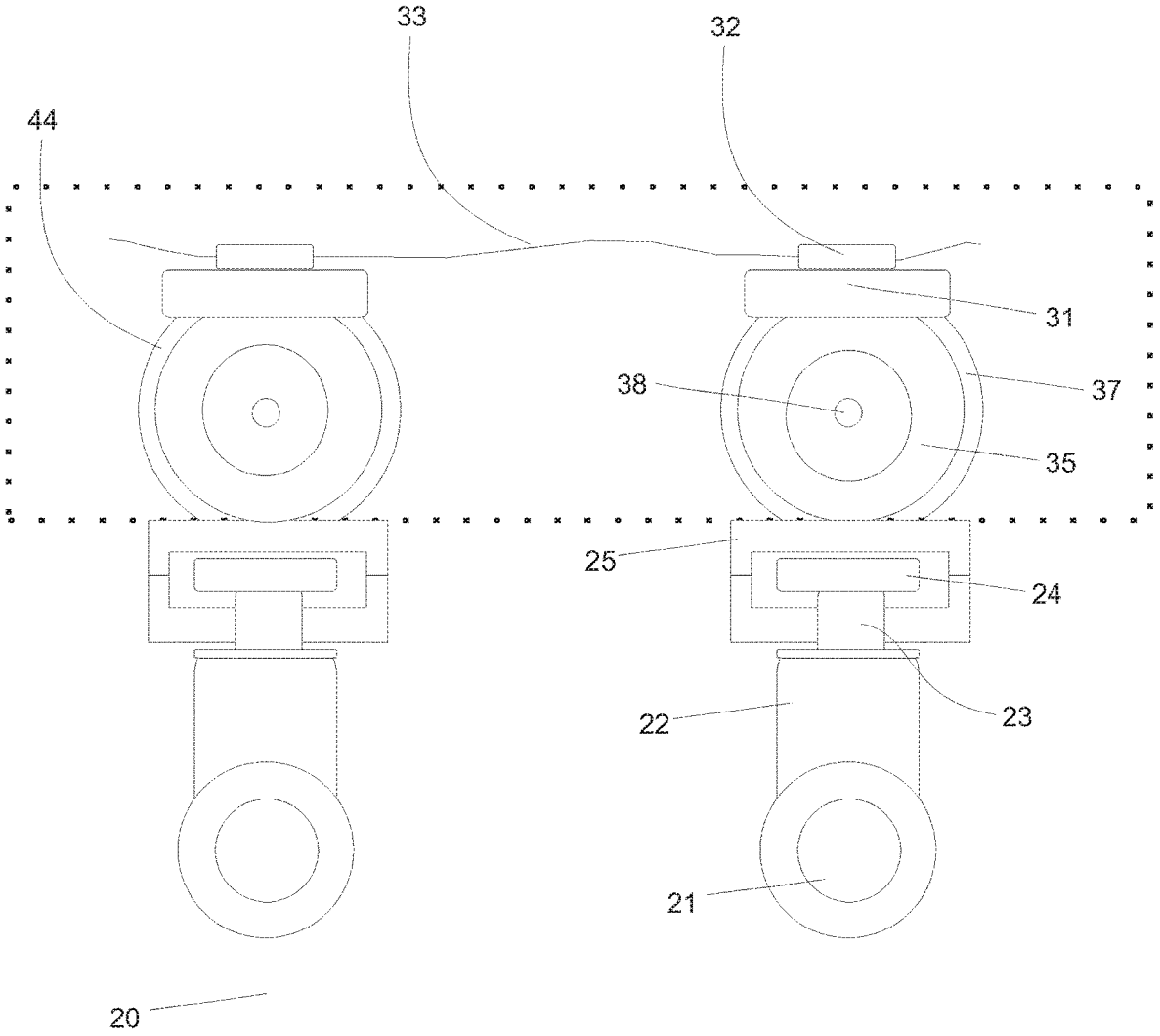
FIG. 1 is a side view of the present invention.
Figure 2:
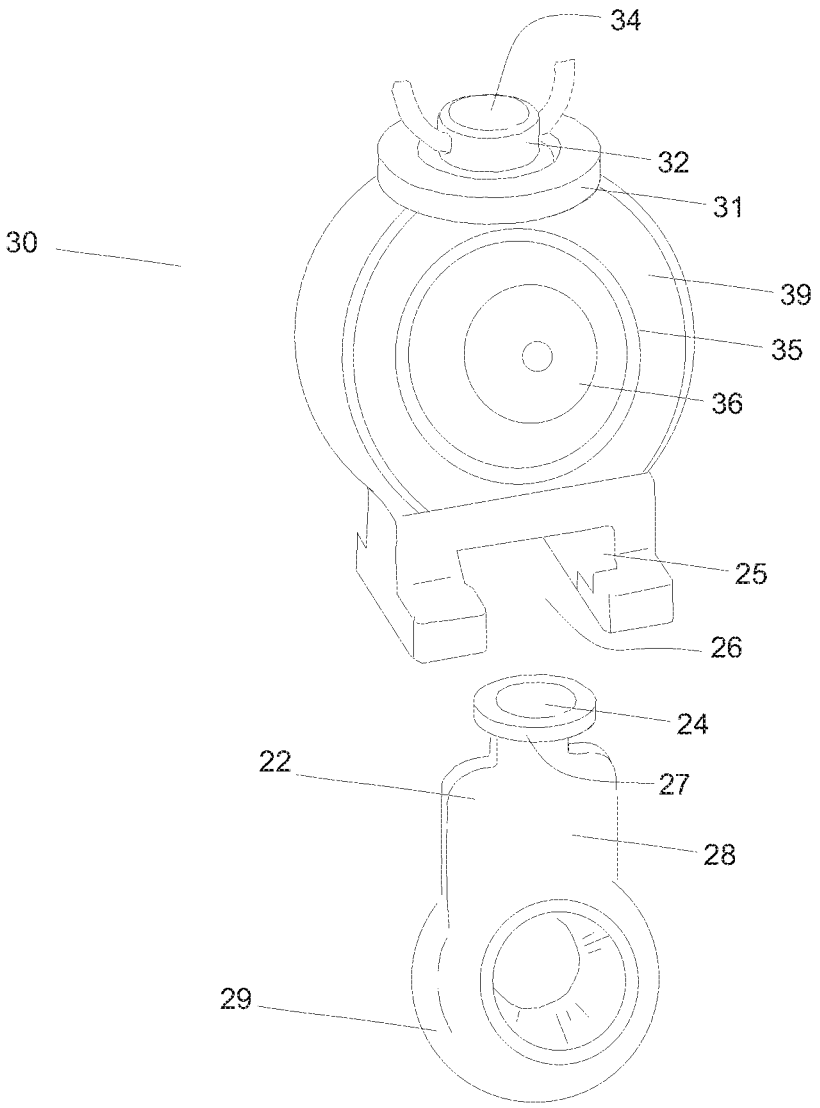
FIG. 2 is an exploded view of the present invention.
Figure 3:
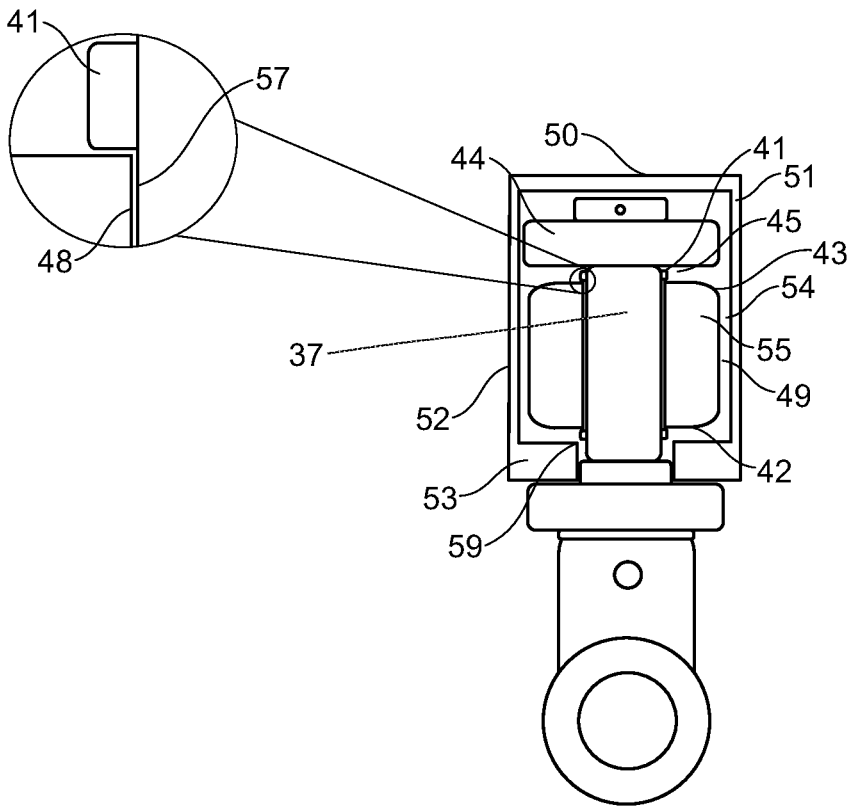
FIG. 3 is a sectional view of the present invention.
Figure 4:
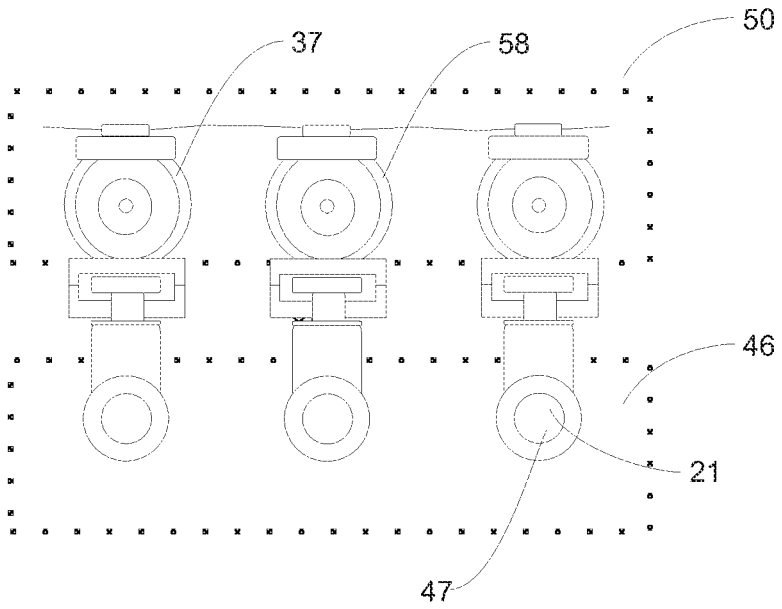
FIG. 4 is an assembled view of the present invention.

The present invention as seen in the drawings is a drapery connector, as seen in FIGS. 1-4. The drapery connector generally has an upper carriage 30 that includes a roller frame 37 with a wheel mounted to the roller frame. The wheel 39 rotates relative to the roller frame 37 on a wheel axle 38 that is mounted to the roller frame 37. The wheel axle 38 may not be visible from the outside and can be covered by a portion of the roller wheel 39. The roller wheel is formed of two separate similar pieces of plastic mounted in a mirror relationship to each other.

The roller frame 37 is rigidly connected to connector body 20 at a swivel socket 25. The connector body 20 includes the swivel socket 25 and the lower connector body 22. The swivel socket 25 holds a connector body swivel head 24 in a pivoting swivel configuration. The connector body swivel head 24 can be integrally formed with a connector body swivel shaft 23 which extends downwardly from the connector body swivel head 24. The connector body swivel head 24 has a larger diameter than the connector body swivel shaft 23. The connector body swivel shaft 23 is preferably cylindrical and supports a lower connector body 22. The lower connector body 22 includes a drapery connector socket 21 that has a drapery connector socket opening for receiving a portion of drapery 46. The drapery connector socket 21 can receive a drapery snap 47 that snaps into the drapery connector socket 21. The drapery snap 47 can be formed as a button such as a metal button having an annular protrusion. The drapery connector socket 21 preferably has an opening that passes through the connector socket frame 29.

In use, the drapery 46 is supported by the drapery snap 47. The drapery snap 47 is supported by the drapery connector socket 21. The drapery connector socket 21 is supported by the connector socket frame 29. The connector socket frame 29 is supported by the lower connector body 22. The lower connector body 22 is supported by the connector body swivel shaft 23. The connector body swivel shaft 23 is supported by the connector body swivel head 24. The connector body swivel head 24 is supported by the swivel socket 25. The swivel socket 25 is supported by the roller frame 37. The roller frame 37 is supported by the wheel axle 38. The wheel axle is supported by the wheel. The wheel is supported by the extrusion 50. The extrusion 50 is in turn mounted to a ceiling or wall.

The swivel head 24 has a disk shape that fits into the swivel socket 25. The connector body swivel head 24 is larger than a swivel socket notch 26 so that the swivel socket notch 26 has an upper surface that bears against a lower surface of the swivel head. The swive connector body head 24 has a swivel head sidewall 27 that is vertically oriented. The lower connector body 22 has a connector body face 28 shaped in a flat planar shape. The connector socket frame 29 extends downwardly from the connector body face 28 and the connector body face 28 has a flat surface that is parallel to the drapery connector socket 21 and the drapery connector socket opening.

The wheel is preferably shaped with a wheel flat face 36 and a wheel sloping wall 35. The wheel sloping wall 35 extends from the wheel flat face 36 and the interface at a roller rounded bevel 43. The wheel has an inside roller bearing 42 that rides on the extrusion. The extrusion is preferably an aluminum extrusion. The upper carriage 30 also has a carriage disk 31 and a carriage stem 32 extending upwardly from the carriage disk 31. The carriage stem 32 receives a carriage line 33. The carriage stem 32 can be formed around the carriage line 33 by being injection molded around the carriage line 33. The carriage stem 32 can be made of plastic and the carriage line 33 can be made of a cord material. The carriage stem 32 preferably has a flat top upper surface called a retainer face 34.

The wheel has a rolling motion inside the extrusion. The wheel is therefore a roller. The wheel has a roller ridge 44 that extends away from the roller frame 37 to form a generally circular roller indent that the roller wheel is recessed within the roller indent. The roller Ridge 44 defines the roller indent 45 such that the inside surface of the wheel is less distal than the roller ridge 44. The wheel has a wheel inside vertical surface 48 and a wheel outside vertical surface 49. The wheel is formed as a pair of rollers, namely a front roller 55 and a rear roller 56, each of which have a wheel inside vertical surface 48 and a wheel outside vertical surface 49. Each roller has a roller indent 45 and a roller seal 41. The roller seal does not necessarily touch and is not an elastomeric gasket, but is rather a very small gap between the roller ridge 44 and the wheel inside vertical surface 48. The roller ridge 44 has a 90° angle that points toward the roller indent 45. The roller ridge 44 acts as a guard to block the carriage line 33 from being entangled between the wheel inside vertical surface 48 and the roller frame 37. The roller ridge 44 can be almost the same level as the roller frame 37, without much of a height difference. The roller indent can be a very slight indent that is barely noticeable.

The aluminum extrusion 50 preferably has an extrusion top wall 51 that can be screwed to a ceiling, and a pair of extrusion sidewalls 52 that each have an extrusion rail wall 53. The extrusion rail wall 53 are the rails that the rollers roll over at the inside roller bearing 42. The extrusion forms an extrusion hollow 54 that the upper carriage 30 rides within in a translational movement. The carriage line 33 connects between successive carriage stems 32 so that the carriage line 33 maintains a set distance between the upper carriage 30 and successive upper carriages 58. The roller frame has a roller frame flat face and the wheel inside vertical surface 48 is mounted very close to the roller frame flat face 57 such that a gap between the wheel inside vertical surface 48 and the roller frame flat face 57 is less than a diameter of the carriage line 33.

A key part of the present invention is that the rail corner 59 of the extrusion rail wall 53 receives the pair of rollers and the rollers ride along the rail corner 59 because the sloping wall slopes toward the wheel axle 38 forming a semi-conical profile of the roller wheels. The sloping wall 35 engaging the rail corner 59 allows the carriage line 33 if looped to slide between the sloping wall 35 and the rail corner 59 and thereby not bind on the roller wheel.

The invention claimed is:

1. A drapery connector comprising:

an extrusion having an extrusion hollow;

a pair of rails formed on the extrusion;

a pair of extrusion sidewalls supporting the pair of rails, wherein an upper carriage is translationally mounted inside the extrusion in the extrusion hollow;

a pair of rollers engaging the extrusion, wherein the pair of rollers share a common axle, wherein the upper carriage comprises the pair of rollers with a common axle;

a roller frame retaining the axle, wherein the roller frame has a roller frame flat face oriented parallel to a wheel inside vertical surface, wherein the upper carriage further comprises the roller frame with a wheel mounted to the roller frame;

a roller ridge that extends away from the roller frame; and a carriage line connecting the upper carriage to a successive upper carriage;

wherein the wheel is formed as the pair of rollers, and each roller has a roller seal, which does not necessarily touch and is not an elastomeric gasket, but contains rather a very small gap between the roller ridge and the wheel inside vertical surface.

2. The drapery connector of claim 1, further comprising: the roller frame flat faces formed on the roller frame, wherein a gap between the wheel inside vertical surface and one of the roller frame flat face is less than a diameter of the carriage line.

3. The drapery connector of claim 2, further comprising: a pair of roller indents formed on the roller frame flat faces, wherein the pair of rollers have the wheel inside vertical surface at least partially within the roller indents.

4. The drapery connector of claim 3, further comprising: a roller rounded bevel formed on the roller between a sloping wall and a wheel flat face, wherein the wheel is shaped with the wheel flat face and the sloping wall, and the sloping wall extends from the wheel flat face and the interface at the roller rounded bevel.

5. The drapery connector of claim 1, further comprising: a swivel socket connected to the roller frame, wherein the swivel socket receives a connector body.

6. The drapery connector of claim 5, wherein the connector body includes a connector body swivel head received into the swivel socket.

7. The drapery connector of claim 6, wherein the connector body further includes a connector body swivel shaft extending downwardly from the connector body swivel head.

8. The drapery connector of claim 7, Further including a connector socket frame having a drapery connector socket, wherein the drapery connector socket receives a drapery snap, wherein the drapery snap is connected to drapery, wherein the connector body further includes a lower connector body, and the connector socket frame is supported by the lower connector body.

9. The drapery connector of claim 8, further comprising: the roller frame flat faces formed on the roller frame, wherein a gap between the wheel inside vertical surface and one of the roller frame flat face is less than a diameter of the carriage line.

10. The drapery connector of claim 9, further comprising: a pair of roller indents formed on the roller frame flat faces, wherein the pair of rollers have the wheel inside vertical surface at least partially within the roller indents.

11. The drapery connector of claim 10, further comprising: a roller rounded bevel formed on the roller between a sloping wall and a wheel flat face, wherein the wheel is shaped with the wheel flat face and the sloping wall, and the sloping wall extends from the wheel flat face and the interface at the roller rounded bevel.

12. The drapery connector of claim 1, wherein the wheel is shaped with a wheel flat face and a sloping wall, wherein a pair of rail corners of the extrusion rail wall receives the pair of rollers and the rollers ride along the rail corner because the sloping wall slopes toward the wheel axle forming a semi-conical profile of the roller wheels.

13. The drapery connector of claim 12, further comprising: the roller frame flat faces formed on the roller frame, wherein a gap between the wheel inside vertical surface and one of the roller frame flat face is less than a diameter of the carriage line.

14. The drapery connector of claim 13, further comprising: a pair of roller indents formed on the roller frame flat faces, wherein the pair of rollers have the wheel inside vertical surface at least partially within the roller indents.

15. The drapery connector of claim 14, further comprising: a roller rounded bevel formed on the roller between the sloping wall and the wheel flat face, wherein the sloping wall extends from the wheel flat face and the interface at the roller rounded bevel.

16. The drapery connector of claim 15, further comprising: a swivel socket connected to the roller frame, wherein the swivel socket receives a connector body.

17. The drapery connector of claim 12, wherein a connector body includes a connector body swivel head received into a swivel socket, wherein the connector body further includes a connector body swivel shaft extending downwardly from the connector body swivel head, further including a connector socket frame having a drapery connector socket, wherein the drapery connector socket receives a drapery snap, wherein the drapery snap is connected to drapery, wherein the connector body further includes a lower connector body, and the connector socket frame is supported by the lower connector body, further comprising a pair of roller frame flat faces formed on the roller frame, wherein a gap between the wheel inside vertical surface and one of the roller frame flat face is less than a diameter of the carriage line, further comprising a pair of roller indents formed on the roller frame flat faces, wherein the pair of rollers have the wheel inside vertical surface at least partially within the roller indents, further comprising: a roller rounded bevel formed on the roller between a sloping wall and a wheel flat face, wherein the sloping wall extends from the wheel flat face and the interface at the roller rounded bevel.

* * * * *